US005983787A

United States Patent [19]

Linsuri et al.

[11] Patent Number: 5,983,787

[45] Date of Patent: Nov. 16, 1999

[54] METHOD FOR CALENDERING A PAPER WEB AND A CALENDAR THAT MAKES USE OF THE METHOD

[75] Inventors: Ari Linsuri; Reima Kerttula; Pekka Kivioja, all of Muurame; Timo Nyberg, Espoo, all of Finland

[73] Assignee: Valmet Corporation, Helsinki, Finland

[21] Appl. No.: 08/841,270

[22] Filed: Apr. 29, 1997

[30] Foreign Application Priority Data

Apr. 29, 1996 [FI] Finland ..... 961816

[51] Int. Cl.[6] ..... D21G 1/00

[52] U.S. Cl. ..... 100/38; 100/153; 100/329; 100/330; 100/332; 162/206; 162/358.5

[58] Field of Search ..... 100/38, 153, 176, 100/306, 308, 327–330, 332, 333, FOR 103, 162 B; 162/205–207, 358.3, 358.5

[56] References Cited

U.S. PATENT DOCUMENTS

| | | | |
|---|---|---|---|
| 3,290,209 | 12/1966 | Ihrman | 162/205 |
| 3,707,752 | 1/1973 | Brafford et al. . | |
| 4,114,528 | 9/1978 | Walker | 100/333 |
| 4,498,383 | 2/1985 | Pav et al. | 100/329 |
| 4,534,829 | 8/1985 | Ahrweiler et al. . | |
| 4,573,402 | 3/1986 | Sharma et al. | 100/38 |
| 4,658,716 | 4/1987 | Boissevain . | |
| 5,011,395 | 4/1991 | Kawamata | 100/330 |
| 5,106,655 | 4/1992 | Boissevain et al. . | |
| 5,156,086 | 10/1992 | Kiema et al. | 100/38 |
| 5,251,551 | 10/1993 | Abe et al. . | |
| 5,483,873 | 1/1996 | Koivukunnas et al. | 100/38 |

FOREIGN PATENT DOCUMENTS

| | | |
|---|---|---|
| 80309 | 7/1983 | Finland . |
| 74065 | 4/1987 | Finland . |
| 92849 | 3/1990 | Finland . |
| 383614 | 4/1972 | Sweden . |

*Primary Examiner*—Stephen F. Gerrity
*Attorney, Agent, or Firm*—Steinberg & Rakin, P.C.

[57] ABSTRACT

A method for calendering a paper web, including the steps of passing the paper web through a calendering nip having a profile formed from a pair of calendering rolls, wherein at least one of the pair of calendering rolls includes a soft exterior face at least in the region of the nip, regulating the profile of the calendering nip to compensate for flaws in the paper web passing through the calendering nip including varying the properties of the soft exterior face locally in a direction transverse to the direction of the passing paper web concurrently with the passing step.

22 Claims, 1 Drawing Sheet

METHOD FOR CALENDERING A PAPER WEB AND A CALENDAR THAT MAKES USE OF THE METHOD

BACKGROUND OF THE INVENTION

The present invention relates to a method for calendering a paper web, wherein the paper web is passed through a calendering nip formed by two rolls, at least one of the rolls being soft-faced by means of a coating of a polymer or equivalent material or by means of a band passed over the roll and running through the nip. The profile of the calendering nip is thereafter regulated in order to compensate for any flaws present in the web which enters the calender.

The invention also relates to a calender that comprises a calendering nip formed between two calender rolls, wherein at least one of the calender rolls is provided with a soft surface layer of a polymer or equivalent material in the form of a coating or a band passed over the roll running through the nip. The calender is provided with regulation devices for regulating the profile of the calendering nip in order to compensate for any flaws present in the web that enters the calendering nip.

It is known in the art of calendering that variations occur in the paper web entering a calendar that originate in the wet end and the dryer section of a paper machine. It therefore must be possible to control the operation of the calender, i.e., the profile of the calendering nip must be adjustable in order to compensate for these defects in the paper web.

Conventionally, the profile adjustment that takes place in the calender has been carried out by varying the diameter of a nip roll locally. The diameter has been conventionally varied, for instance, by locally heating the mantle of a metal roll or by cooling it correspondingly. Such has been accomplished by, among other things, the use of hot-air-blowing, infrared heating and different electric heating members.

However, disadvantages occur while using this method. For example, it is overly time consuming to cool a heated section of the roll. In addition, due to the fact that the mantle of the roll is most often formed of metal, it is difficult to locally heat a section of the roll because the heat is often conducted in the mantle. Moreover, when heating different sections of the roll, it is necessary to heat each section at a different temperature (the difference being relatively high). This, in turn, affects the gloss of the paper, i.e., the paper web may have more glossy or less glossy streaks after calendering.

A roll adjustable in zones represents a newer technology in the regulation of the calender profile. However, this construction does not allow the use of the narrow adjustment zones discussed above.

A method as described above is shown, for example, in U.S. Pat. No. 4,658,716, which discloses a calendering roll having a plurality of infrared heaters arranged thereon in the axial direction of the roll. The infrared heaters adjust the diameter of the calendering roll in order to compensate for the variations that occur in the transverse direction of the paper web entering the calendering nip, i.e., the heaters adjust the profile of the calendering nip by heating the metal roll externally.

OBJECTS AND SUMMARY OF THE INVENTION

An object of the present invention is to provide a method for calendering a paper web, as well as a calender that makes use of the method, which provide an improvement in the adjustment of the profile of a calendering nip, by which the disadvantages associated with prior art methods and calenders are avoided.

In order to attain the objects of the invention, the profile regulation is carried out during the running of the machine by varying the properties of a coating or, correspondingly, of a band, arranged on the exterior face of a roll in a direction transverse to the machine direction. Specifically, in accordance with the present invention, a method for calendering a paper web is provided which includes the steps of passing the paper web through a calendering nip formed from a pair of calendering rolls, wherein at least one of the pair of calendering rolls has a soft exterior face at least in the region of the nip. The profile of the calendering nip is then regulated to compensate for flaws in the paper web passing through the calendering nip by locally varying the properties of the soft exterior face, preferably using heat, in a direction transverse to the direction of the passing paper web while the machine is operating.

In a preferred embodiment of the invention, the soft exterior face is a polymer coating or a band which is applied to the calendering roll. The coating or band can be softened by locally applying heat or hardened by locally cooling it.

In another preferred embodiment of the invention, varying of the properties of the soft exterior face is accomplished by arranging a plurality of heating devices uniformly along the axial length of the soft exterior face. It is possible to place the heating devices equal to or less than about 100 mm apart and adjacent ones of the heating devices can have temperature differences less than 1° C.

In the calendar of the invention, profile regulation devices are disposed in association with a calender roll provided with a soft exterior face and are arranged to vary the properties of the soft exterior face in a desired way in a direction transverse to the machine direction. Specifically, in accordance with the present invention, a calender for calendering a paper web is provided which includes a pair of calender rolls and a calendering nip defined by the calender rolls for receiving the paper web. At least one of the calender rolls includes a soft exterior face at least in the region of the nip. Regulating means are provided for regulating the profile of the calendering nip in order to compensate for flaws present in the paper web entering the calendering nip. The regulating means, preferably heating devices, are arranged in association with the calender roll having the soft exterior face in a direction transverse to the moving direction of the paper web in order to vary the properties of the soft exterior face.

In a preferred embodiment of the invention, the soft exterior face is a polymer coating which is applied to the calendering roll. In another preferred embodiment of the invention, the soft exterior face is a band and the calender further includes a guide roll such that the band, preferably a reinforced polymer band, is arranged partially around one of the calender rolls and partially around the guide roll.

In another preferred embodiment of the invention, the regulating means include a plurality of heating devices arranged in association with the soft exterior face, wherein each heating device locally heats the soft exterior face.

The invention provides a considerable advantage over the prior art. For example, local profile regulation can be performed in a simpler fashion in the axial direction of the roll because, among other things, the temperature difference required in the axial direction are small, i.e., substantially smaller than previously. The temperature differences may even be less than about 1° C. Since, in the method according to the invention, a metal roll or a metal mantle of a roll is not sought to be heated for the purpose of profile adjustment, it is possible to place heating devices closer to each other than previously. This is so because, in the arrangement according to the invention, it is possible to heat a very narrow area of the soft exterior face of the roll in such a way that heat from this area does not spread elsewhere in the axial direction of the roll. This is due to the fact that the soft exterior face of the roll is formed from a thermally insulative material. Another significant advantage over prior arrangements is that profile regulation can be carried out more quickly in both directions when compared with previous heat profiling. The further advantages and characteristic features of the invention come out from the following detailed description of the invention.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE INVENTION

Figure 1:
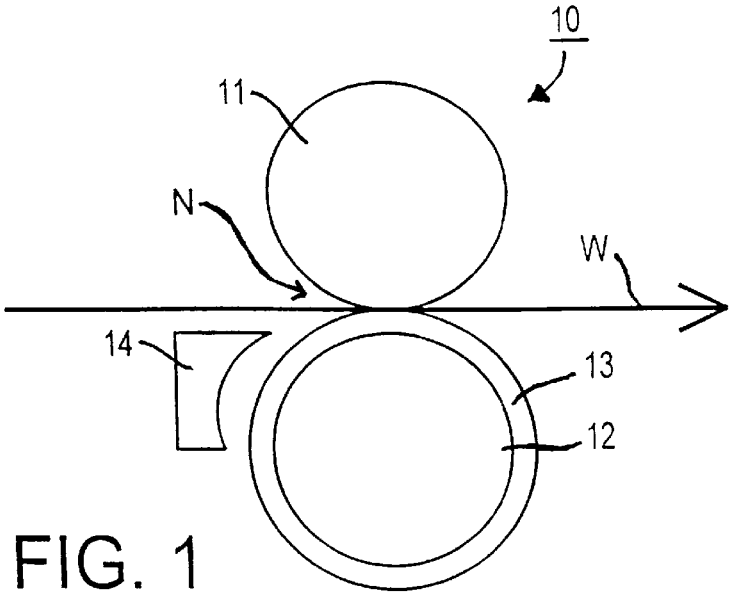
FIG. 1 is a schematic diagram of a two-roll calender, in which one of the calender rolls includes a soft exterior face formed from a polymer coating.

In FIG. 1, the calendar is denoted generally with reference numeral 10. The calender 10 is a two-roll calender, where calender rolls 11, 12 form a calendering nip N therebetween. A paper web W passes through the nip N in the manner shown in the figure. The first calender roll 11 is a hard-faced roll, preferably a metal roll, whereas the other calender roll 12 is provided with a soft exterior face or coating 13. The coating is preferably made of a polymer material or of an equivalent material suitable for the purpose.

The reference numeral 14 in FIG. 1 denotes a heating device. Since FIG. 1 is a side view of the calender 10, only one heating device 14 is shown in the figure. However, it is noted that there are a plurality of such heating devices 14 arranged in the axial direction of the roll 12 in such a way that the heating devices 14 are evenly spaced over the axial length of the roll 12. It is possible to evenly dispose heating devices 14 at about 100 mm intervals.

In other embodiments, the heating devices 14 can be arranged at even shorter intervals in the axial direction of the roll 12. It is pointed out that it is also possible to have only one heating device movably arranged in association with the roll.

The properties of the coating 13 are varied by means of the heating devices 14 such that the linear load distribution in the nip N can be adjusted as desired. The coating 13 is softened locally by the heat produced by the heating devices 14 in accordance with the properties of the web W entering the nip N. The heat effect does not spread in the transverse direction of the web W, because the coating 13 insulates well against heat. That is, the coating is formed from a thermally insulative material. The utilization of coating 13 allows the desired effects to be achieved with lower heat amounts and temperatures than previously. In addition, the local temperature difference that is necessary between adjacent heating devices is small and can be below about b 1° C. Thus, the energy required by the heating devices 14 is also small. In addition, regulation of the coating can be made very rapidly in both directions, as compared, for instance, with a situation wherein the metal roll 11 is heated and cooled in a corresponding way.

Figure 2:
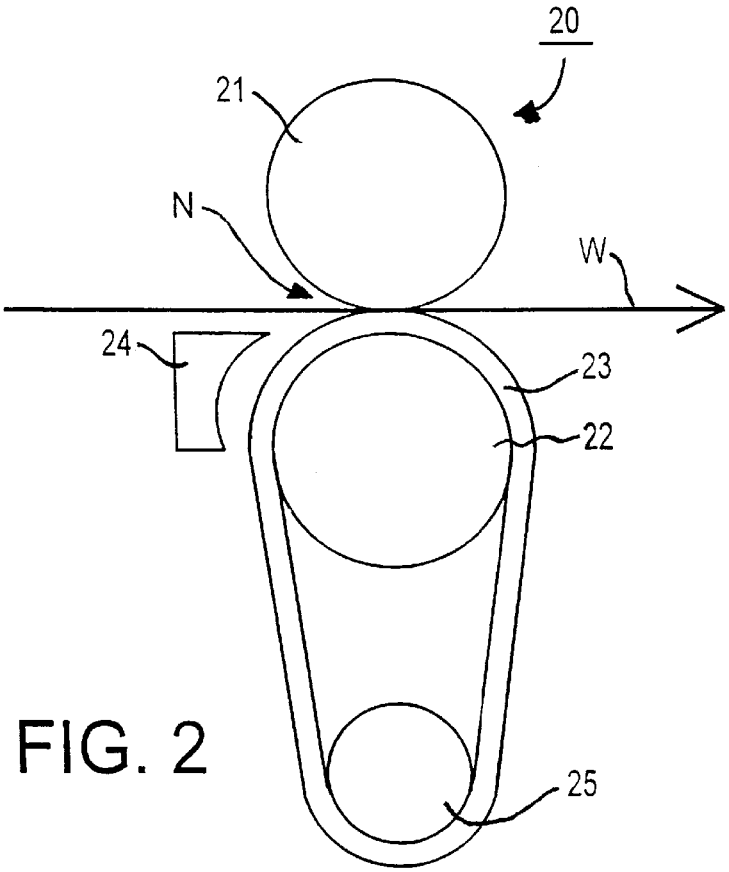
FIG. 2 is a schematic diagram of a two-roll calender, in which a resilient band is arranged to run about one of the calender rolls.

In the arrangement shown in FIG. 2, the calender is denoted generally with the reference numeral 20. A calendering nip N is formed in the embodiment of FIG. 2 between rolls 21, 22, of which the first roll 21 is a hard-faced roll. The web W passes through nip N as described in connection with FIG. 1. The second calender roll 22 is also a hard-faced roll. However, an endless belt, e.g. a band or equivalent 23, is passed over the second calender roll 22 and a guide roll 25. The material of the band 23 is, for instance, a reinforced polymer band, in which the polymer material is similar to that used for the coating 13 of the roll 12 shown in FIG. 1. Thus, the properties of the band 23 correspond to the properties of the coating 13. The calender 20 further includes heating devices 24, whose intended use and operation is similar to that described in connection with the heating devices 14 in FIG. 1.

The profile adjustment in the above-description is proposed to be performed by means of heat. However, it is possible for the coating 13 or the band 23 to be, for instance, layered in such a way that it includes a layer that is sensitive to a profile regulation device. In this embodiment, the regulation might be carried out, for instance, by means of microwaves, a magnetic field or the like.

In the profile regulation carried out by means of heat, heat can be provided, for instance, by infrared heaters by means of heat blowing or in some other equivalent fashion.

Obviously, numerous modifications and variations of the present invention are possible in light of the teachings hereof. Therefore, it is to be understood that the invention can be varied from the detailed description above within the scope of the claims appended hereto.

We claim:

1. A method for calendering a paper web, comprising the steps of:

passing the paper web through a calendering nip having a profile formed by first and second calender rolls;

arranging a material having different degrees of softness in conjunction with the first calender roll such that the web is passed between the material and the second calender roll;

regulating the profile of the calendering nip by varying the degree of softness of the material locally in a direction transverse to the direction of the passing paper web concurrently with passage of the web through the calendering nip such that any flaws in the web may be compensated for; and the step of varying the degree of softness of the material comprising the step of applying heat to the material to soften the material by means of a plurality of heating devices arranged uniformly along the axial length of the first calender roll at intervals not more than about 100 mm.

2. The method according to claim 1, wherein the material is in the form of a band guided in a run to pass over the first calender roll and through the nip.

3. The method according to claim 1, wherein the step of applying heat to the material further comprises the step of adjusting the temperature of adjacent ones of the heating devices to be different from each other by less than about 1° C.

4. A calender for calendering a paper web moving in a desired direction, comprising:

first and second calender rolls;

a calendering nip defined by said calender rolls and through which the paper web passes, said calendering nip having a profile;

a material having different degrees of softness arranged on said first calender roll such that the web is passed between said material and said second calender roll; and regulating means for regulating said profile of said calendering nip, said regulating means comprising infrared heaters arranged in association with said first calender roll in a direction transverse to the moving direction of the paper web in order to vary the degree of softness of said material.

5. The calender according to claim 4, wherein said material comprises a coating applied to said first calender roll.

6. The calender according to claim 5, wherein said coating is a polymer.

7. The calender according to claim 4, wherein said regulating means are arranged to vary the temperature of said material locally in order to vary the softness of said material.

8. The calender according to claim 4, wherein said material is sensitive to said regulating means.

9. The calender according to claim 4, wherein said material includes a thermally insulative material.

10. The calender according to claim 4, wherein said infrared heaters are arranged along the axial length of said first calender roll.

11. The calender according to claim 10, wherein said infrared heaters are arranged uniformly along the axial length of said first calender roll.

12. The calender according to claim 11, wherein said infrared heaters are arranged uniformly at intervals of not more than about 100 mm.

13. The calender according to claim 11, wherein adjacent ones of said infrared heaters have temperatures which vary from each other by less than about 1° C.

14. A calender for calendering a paper web moving in a desired direction, comprising:

first and second calender rolls;

a guide roll spaced from said first calender roll;

a calendering nip defined by said calender rolls and through which the paper web passes, said calendering nip having a profile;

a reinforced polymer band having different degrees of softness arranged to run around said first calender roll and said guide roll such that the web is passed between said band and said second calender roll; and regulating means for regulating said profile of said calendering nip, said regulating means comprising infrared heaters arranged in association with said first calender roll in a direction transverse to the moving direction of the paper web in order to vary the degree of softness of said band.

15. A calender for calendering a paper web moving in a desired direction, comprising:

first and second calender rolls;

a calendering nip defined by said calender rolls and through which the paper web passes, said calendering nip having a profile;

a material having different degrees of softness arranged on said first calender roll such that the web is passed between said material and said second calender roll; and regulating means for regulating said profile of said calendering nip, said regulating means comprising means arranged in association with said first calender roll and in a direction transverse to the moving direction of the paper web for directing microwaves or a magnetic field at said material in order to vary the degree of softness of said material.

16. A method for calendering a paper web, comprising the steps of:

passing the paper web through a calendering nip having a profile formed by first and second calender rolls, wherein at least one of the pair of calendering rolls includes a soft exterior face having different degrees of softness at least in the region of the nip, and regulating the profile of the calendering nip by varying the degree of softness of the soft exterior face locally in a direction transverse to the direction of the passing paper web concurrently with passage of the web through the calendering nip such that any flaws in the web may be compensated for, the step of varying the degree of softness of the soft exterior face comprising the step of applying heat to the soft exterior face by means of a plurality of heating devices arranged uniformly along the axial length of the first calender roll at intervals not more than about 100 mm.

17. The method according to claim 16, wherein the soft exterior face comprises a coating applied to the at least one of the pair of calendering rolls.

18. The method according to claim 17, wherein the coating is a polymer.

19. The method according to claim 16, wherein the step of varying the degree of softness of the material further comprises the step of cooling the material to harden the material.

20. The method according to claim 16, wherein the step of varying the degree of softness of the material further comprises the step of hardening the soft exterior face by locally cooling the soft exterior face.

21. The method according to claim 16, wherein the material is thermally insulative.

22. A method for calendering a paper web, comprising the steps of:

passing the paper web through a calendering nip having a profile formed by first and second calender rolls, wherein at least one of the pair of calendering rolls includes a soft exterior face having different degrees of softness at least in the region of the nip, regulating the profile of the calendering nip by varying the degree of softness of the soft exterior face locally in a direction transverse to the direction of the passing paper web concurrently with passage of the web through the calendering nip such that any flaws in the web may be compensated for, the step of varying the degree of softness of the soft exterior face comprising the step of applying heat to the soft exterior face by means of a plurality of heating devices arranged uniformly along the axial length of the first calender roll, and adjusting the temperature of adjacent ones of the heating devices to be different from each other by less than about 1° C.

* * * * *